US006112043A

United States Patent [19]

Sakuraba

[11] Patent Number: 6,112,043

[45] Date of Patent: Aug. 29, 2000

[54] DEVELOPING APPARATUS HAVING A CONTACT ROLLER, AN IMAGE FORMING APPARATUS USING THIS

[75] Inventor: Tamotsu Sakuraba, Okazaki, Japan

[73] Assignee: Minolta Co., Ltd., Osaka, Japan

[21] Appl. No.: 09/348,837

[22] Filed: Jul. 8, 1999

[30] Foreign Application Priority Data

Jul. 15, 1998 [JP] Japan ..... 10-199397

[51] Int. Cl.[7] ..... G03G 15/08

[52] U.S. Cl. ..... 399/281; 399/284; 399/285

[58] Field of Search ..... 399/281, 149, 399/284, 285, 359, 150

[56] References Cited

U.S. PATENT DOCUMENTS

| | | | |
|---|---|---|---|
| 4,378,158 | 3/1983 | Kanbe | 399/281 |
| 5,086,728 | 2/1992 | Kinoshita | 399/281 |
| 5,170,213 | 12/1992 | Yamaguchi et al. | 399/281 |
| 5,606,397 | 2/1997 | Honda et al. | 399/98 |

FOREIGN PATENT DOCUMENTS 3-44666 2/1991 Japan .

*Primary Examiner*—William Royer
*Assistant Examiner*—Hoan Tran
*Attorney, Agent, or Firm*—Burns, Doane, Swecker & Mathis, LLP

[57] ABSTRACT

The inventive developing apparatus 10 includes: a developing roller 15 rotating in a predetermined direction; a regulating blade 16 for regulating layer thickness of developer G1 on the developer roller; 15; and a supplying roller 17 disposed at the upper stream than the regulating blade 16 while the developing apparatus 10 rotates in the predetermined direction. Further, the developing apparatus 10 rotates the developing roller 15 in the reverse direction for the predetermined direction during a predetermined period. Thereby, agglomerates stopping at the space between the developing roller 15 and the regulating blade 16 escape therefrom and developer leak and defective supply of developer and the like are cleared away. While the developing roller 15 is rotated in the reverse direction, the agglomerates escaped from the space come to contact with the supplying roller 17 and are crashed by press of the developing roller 15 and the supplying roller 17. As a result, agglomerates escaped from the space between the regulating blade 16 and the developing roller 15 is prevented from stopping therebetween again and accumulating in developer.

20 Claims, 2 Drawing Sheets

DEVELOPING APPARATUS HAVING A CONTACT ROLLER, AN IMAGE FORMING APPARATUS USING THIS

This application is based on application No. 10-199397 filed in Japan, the contents of which is hereby incorporated by reference.

BACKGROUND OF THE INVENTION

1. Field of the Invention

The present invention relates to a developing apparatus used for image forming apparatuses such as monochrome or color copying machine and printer. More particularly, the present invention relates to a developing apparatus and an image forming apparatus using this wherein developer leak and defective supply of developer caused by partial agglomeration of developer are prevented by removing agglomerates of developer.

2. Description of the Prior Art

An image forming apparatus for a copying machine and a printer forms an image on a recording medium as follows. That is, an image forming apparatus gets surface of a photosensitive drum charged at first, then, the charged surface receives exposure to light and forms an electrostatic latent image thereon. Next, a developing apparatus lets developer adhere to the electrostatic latent image on the surface of the photosensitive drum to obtain a toner image. After that, the developing apparatus transfers the toner image onto a recording medium.

In the developing apparatus, developer is supplied from a supplying member to a developer carrier. Then, a regulating member regulates thickness of developer layer on the developer carrier to make the developer layer constant and thereby, extra developer is removed therefrom. Such developing process is carried out so that an image formed on a recording medium should have predetermined density.

When non-magnetic one-component toner type developer is used for development, pluralities of developer particles sometimes gather together and form agglomerates of developer which are several ten times as large as singularity of particles in size. When the agglomerates stop at a space between the regulating member and the developer carrier, the regulating member is partially raised by the agglomerates. As a result, the space between the regulating member and the developer carrier is partly widened. From the widened portion, developer leaks because developer exceeding inherent regulated thickness of developer passes through the widened portion and is carried onto the developer carrier. The agglomerates themselves stop at the space and prevent developer from passing therethrough. Thereby, defective supply of developer occurs at the downstream for the developer carrier in rotating.

Conventionally, there have existed measures to rotate a developer carrier in a reverse direction and thereby, agglomerates stopping at a space between a regulating member and a developer carrier can be removed therefrom. However, such measures only aim to remove the agglomerates from the space. Therefore, the removed agglomerates are likely to stop at the space again and all efforts to remove the agglomerates from the space go for nothing after all.

SUMMARY OF THE INVENTION

The present invention is intended to solve the above-described problems of the conventional developing apparatus. Its prime object is to provide a developing apparatus and an image forming apparatus using this, wherein agglomerates of developer disappear so as to avoid the agglomerates stopping between a regulating member and a developer carrier, whereby developer leak and defective supply of developer are prevented.

In order to achieve the above objectives, the inventive developing apparatus includes: a developer carrier for carrying developer onto surface thereof, the develop carrier rotating in a predetermined direction; a regulating member for regulating thickness of a developer layer on the developer carrier; and a contact member being in contact with the surface of the developer carrier at upper stream than the regulating member while the developer carrier is rotated in its predetermined rotating direction.

Also, the inventive image forming apparatus includes an image carrier for carrying a latent image on surface thereof and such a developing apparatus as described above for getting the latent image developed by supplying developer onto the image carrier.

In this case, the developer carrier rotates in a predetermined direction and, further, it can rotate in reverse direction, as well. It is preferable that the developing device employs a controller for rotating the developer carrier in a reverse direction for the predetermined direction during a predetermined period. In that case, "a predetermined period" is set to periods except a period when developer is supplied from the developer carrier to an image carrier, such as a photosensitive drum.

In the present invention, a regulating member usually regulates thickness of a developer layer on the developer carrier when the developer carrier rotates in a predetermined direction. If agglomerates form in developer, the agglomerates sometimes stop at a space between the regulating member and the developer carrier. At this time, the developer carrier is rotated in a direction reverse to the predetermined direction during a predetermined period. Subsequently, the agglomerates stopping at the space escape therefrom. Thereby, agglomerates' stopping at the space is cleared away.

The agglomerates escaped from the space are transferred in a direction reverse to the normal rotating direction while being carried onto the surface of the developer carrier. Then, the agglomerates come to contact with the contact member. Thereby, the agglomerates are cracked due to shock when coming to contact with the contact member or pressure between the developer carrier and the contact member and subsequently change into particles. As a result, the agglomerates once escaped from the space between the regulating member and the developer carrier will riot stop there again. Moreover, agglomerates will not accumulate even if the developing apparatus is operated for a long time.

Therefore, frequency that agglomerates stop at the space between the regulating member and the developer carrier is lowered, whereby the regulating member can surely regulate thickness of a toner layer on the developer carrier. Subsequently, thin layer of developer is constantly made even. Thereby, developer leak, defective supply of developer and the like are suppressed and as a result, high-quality images can be obtained.

In the present invention, the contact member may additionally have function to be pressed to the developer carrier. Having the additional function, the contact member can more surely crack agglomerates of developer. Alternatively, it may be beneficial for the contact member to have function to collect agglomerates of developer.

In the present invention, the contact member may concurrently work as a developer supplying member for supplying developer onto the developer carrier. Furthermore, the contact member may concurrently work as a developer collecting member for collecting developer remaining on the developer carrier after development, too. Designed as the above, the inventive developing apparatus needs not to be provided with a developer-supplying/developer-collecting member other than a contact member.

An elastic roller may be used for the contact member. In this case, at most the surface area of the contact member may be made of an elastic body. Specifically, a columnar-shaped member with its surface covered with a foam layer may be used as a contact member.

In the present invention, the developer carrier needs to be rotated in the reverse direction for the predetermined rotating direction during a predetermined period: at least until a position of the developer carrier that faced to the regulating member reaches the contact member. Otherwise, the contact member cannot crack agglomerates escaped from the space between the developer carrier and the regulating member and there occurs a fear that the escaped agglomerates stop at the space again.

In order to avoid such a fear, while it is assumed as below:

L: angle formed by a line connecting the center of developer carrier and a facing point for the regulating member and the developer carrier and a line connecting the center of the developer carrier and a contact point for the developer carrier and contact member;

V: angular velocity when the developer carrier rotates in the reverse direction;

it is required that the developer carrier be rotated in the reverse direction at least for a period expressed with L/V.

Applicability of the present invention is significant for an apparatus wherein one-component developer, above all, nonmagnetic one-component developer is used to let the developer fly to a photosensitive drum from a developer carrier. That is, this type of apparatus is likely to cause problems due to agglomerates of developer.

An apparatus according to the present invention typically employs a power source unit for applying voltage which is a superimposing of DC voltage and AC voltage, to a developer carrier. This is to apply voltage as developing bias to the developer carrier.

DESCRIPTION OF THE PREFERRED EMBODIMENT

Figure 1:
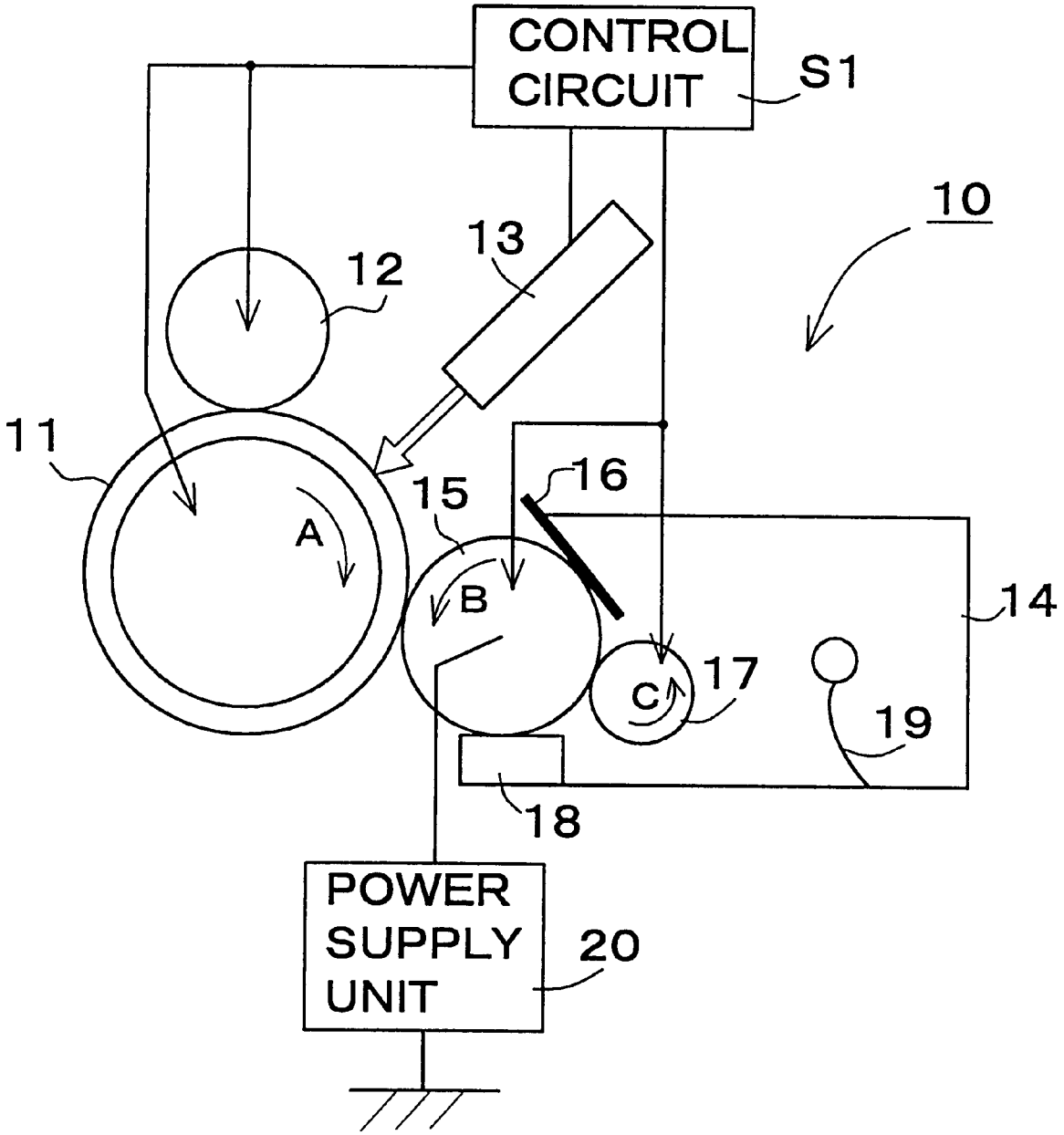
FIG. 1 is a schematic diagram showing an image forming apparatus according to an embodiment.

The detailed aspects of a preferred embodiment according to the present invention will be explained based on the drawings. The preferred embodiment relates to a developing apparatus for an image forming apparatus such as a copying machine and a printer, wherein non-magnetic one-component developer is used. FIG. 1 shows the main part of an image forming apparatus according to the present embodiment. Furthermore, the vicinity of a regulating blade in the main part is shown in FIG. 2 as a magnified diagram.

An image forming apparatus shown in FIG. 1 includes: a developing apparatus 10; a photosensitive drum 11; a charging roller 12; light writing unit 13; and a control circuit S1. The photosensitive drum 11 is an image carrier the surface of which is, for example, a photosensitive layer such as an organic photosensitive material charged in negative, and has a columnar shape of about 30 mm in diameter. In this image forming apparatus, the photosensitive drum 11 rotates in direction A at a running speed of about 100 mm/s at periphery with its surface uniformly charged by the charging roller 12, and the light writing unit 13 exposes to light for the surface of the photosensitive drum 11 to form an electrostatic latent image thereon.

Figure 2:
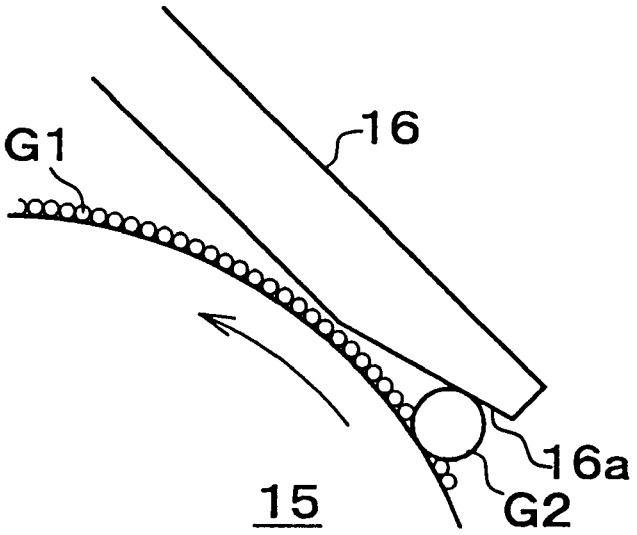
FIG. 2 is a magnified diagram showing the vicinity of a regulating blade for the image forming apparatus according to FIG. 1.

The developing apparatus 10 gets the electrostatic latent image on the photosensitive drum 11 developed using developer G1 (see FIG. 2). The developer G1 used herein is non-magnetic one-component toner made of, for example, polyester type resin particles to which coloring agent is applied and diameter of the particles is 8.5 $\mu$m in average. Surface voltage at a position where the photosensitive drum 11 faces to the developing apparatus 10 is of about −100V at an electrostatic latent image portion (an exposure portion) and of about −800V at an out-of-electrostatic latent image portion (a background portion). Thereby, developer G1 adheres to only the electrostatic latent image portion and subsequently a toner image forms corresponding to the electrostatic latent image. That is, the electrostatic latent image develops with the toner. A control circuit S1 consisting of well-known CPU and the like controls formation and development of an electrostatic latent image.

The developing apparatus 10 will be explained further. The developing apparatus 10 has a hopper 14 for accommodating developer G1. The hopper 14 houses: a developing roller 15 as a developer carrier; a regulating blade 16 as a regulating member; a supplying/collecting roller 17 (referred to as a supplying roller hereinafter) as a contact member as well as a developer-supplying/collecting member; a discharging member 18; and a stirring blade 19. The developing roller 15 connects with a developing-bias power supply unit 20 for applying developing5 bias voltage to the developing roller 15.

The developing roller 15 is a columnar-shaped member made of electrically conductive material and disposed very close to the photosensitive drum 11. The developing roller 15 gets an electrostatic image developed while rotating in arrow B direction with running speed of about 200 mm/s at periphery. More specifically, the developing roller 15 is a columnar shape of about 17 mm in diameter and the surface of it is coated with an of about 1 mm—thick elastic layer 21 (see FIG. 3).

The regulating blade 16 is an of about 0.1 mm—thick plate member and the bottom side of its lower end is a tapered surface **16*a* (see FIG. 2). The upper end of the regulating blade 16 is fixed to the hopper 14 whereas the lower end is in contact with the developing roller 15. The contact position for the regulating member 16 and the developing roller 15 is at upper stream than a position where the developing roller 15 and the photosensitive drum 11 meet closest (referred to as developing position hereinafter) while the developing roller 15 rotates in arrow B direction in FIG. 1. From the contact position for the regulating blade 16*a* and the developing roller 15, the tapered surface 16*a* protrudes toward the supplying roller 17 and faces to the surface of the developing roller 15. The regulating blade 16 is designed to press the developing roller 15 with pressure of about 4 gf/mm. The distance between the tip of the tapered surface 16*a* and the surface of the developing roller 15 is set to between about 50 and 100 μm. The regulating blade 16 makes thickness of the thin layer of developer G1 on the developing roller 15 constant. FIG. 2 shows a state that the regulating blade 16 slightly comes apart from the developing roller 15 due to agglomerate G2 stopping between the blade 16 and the developing roller 15**.

The supplying roller 17 is a columnar-shaped member of about 13 mm—diameter and disposed at the upper stream than the regulating blade 16 while the developing roller 15 is rotated in a direction (arrow B direction in FIG. 1). The supplying roller 17 rotates in arrow C direction shown in FIG. 1 (the same as the arrow B direction) while being in contact with the developing roller 15. Thereby, the supplying roller 17 supplies developer G1 onto the surface of the developing roller 15. Further, the supplying roller 17 collects developer G1 which has passed the discharging member 18 but still remains on the developing roller 15 after development. Still further, the supplying roller 17 concurrently works as a contact member which comes to contact with agglomerate G2 referred to hereinafter. That is, the supplying roller 17 cracks the agglomerate G2 remaining on the developing roller 15 with frictional force between the developing roller 15 and the supplying roller 17 or the like.

To fulfill the functions described above, the supplying roller 17 is made of an elastic member. Its surface is an of about 3 mm-thick foam layer 22 (see FIG. 3). The supplying roller 17 is disposed to be pressed against the developing roller 15. The supplying roller 17 may be made of electrically conductive material with desired bias voltage applied thereto.

The voltage the developing bias power supply unit 20 applies to the developing roller 15 is a superimposing of direct current component (of about −500 V) as a setting value of developing bias and alternative current component (of about Vpp 2000 V, frequency of about 2 kHz) for forming alternating electrical field. When developing bias voltage Vb is applied to the developing roller 15, the developer G1 on the developing roller 15 changes into powder-clouded state.

The discharging member 18 discharges so as to peel the developer G1 remaining on the developing roller 15 after development. Accordingly, the discharging member 18 is made of foamed-sponge-structured electrically conductive resin and disposed adhering to the developing roller 15 without a space.

The stirring blade 19 disposed within the hopper 14 is designed to stir developer G1 inside the hopper 14. The stirring blade 19 is provided so as to supply the developer G1 to the supplying roller 17 neither too much nor too little.

Next, operation of the developing apparatus 10 will be explained. Within the developing apparatus 10, developer G1 is stirred by the rotation of the stirring blade 19. Thereby, the developer G1 is pushed toward the supplying roller 17 and then, gets charged by friction caused when coming to contact with the supplying roller 17 rotating. The charged developer G1 adheres to the peripheral surface of the supplying roller 17 electrostaticaly. Then, the developer G1 is transferred by rotation of the supplying roller 17 (in arrow C direction in FIG. 1) and supplied onto the developing roller 15.

The developer G1 is carried onto the peripheral surface of the developing roller 15 and transferred by rotation of the developing roller 15 (in arrow B direction in FIG. 1). Then, the developer G1 on the developing roller 15 is leveled by the regulating blade 16 in a thin-layer state. Thereby, constant thin layer of developer G1 which is 1.5 times as thick as the average diameter of the developer G1 is formed on the developing roller 15 after the developing roller 15 passes the regulating blade 16. The thin layer of the developer G1 is used for development of the electrostatic latent image on the photosensitive drum 11. That is, at the developing position, bias electrical field is formed between the developing roller 15 and the photosensitive drum 11 due to developing bias voltage generated by developing bias electric power supply unit 20. Therefore, the developer G1 on the developing roller 15 flies to the photosensitive drum 11 to adhere to an electrostatic latent image.

While the developing apparatus 10 is operated, pluralities of particles of developer G1 which is non-magnetic one-component toner sometimes gather and form agglomerates G2 diameter of which is ten-several times as large as that of a single particle. When such agglomerates G2 are carried onto the developing roller 15 together with typical developer G1 (see FIG. 2), the agglomerates G2 sometimes stop at the space between the regulating blade 16 and developing roller 15. Subsequently, since the agglomerates G2 stopping at the space hold back developer G1 behind the agglomerates G2, the developer G1 is not carried onto the developing roller 15 at the down stream. As a result, defective supply of developer occurs. White stripes in an image account for the defective supply of developer onto the developing roller 15.

At the portion at which the agglomerate G2 stops, the agglomerate G2 partly raises the regulating blade 16 (see FIG. 2). Subsequently, at the both sides of the agglomerate G2, excessive amount of developer G1 can pass through the space between the regulating blade 16 and the developing roller 15 raised by the agglomerate G2. As a result, a thin layer of developer G1 thicker than inherent thickness of the thin layer forms at the portion at which the agglomerate G2 stops. This accounts for developer leak. Due to the developer leak, uneven image density occurs. Furthermore, the developer leak causes a phenomenon that developer G1 scatters within the developing apparatus (contamination with developer).

In order to avoid the above phenomenon, the control circuit S1 is designed to periodically rotate the developing roller 15 in the reverse direction for the arrow B direction in FIG. 1. By doing this, the agglomerate G2 stopping at the space between the developing roller 15 and the regulating blade 16 can escape therefrom, thereby the above-described problem is solved. Then the agglomerate G2 escaped comes to contact with the supplying roller 17 as the developing roller 15 rotates in the reverse direction. When being contact with the supplying roller 17, the agglomerate G2 receives shock and frictional force generated between the developing roller 15 and the supplying roller 17 and the like, whereby the agglomerates G2 cracks. Accordingly, agglomerate G2 once escaped will never stop at the space between the regulating member 16 and the developing roller 15 again. In addition, inside the hopper 14, agglomerates G2 never accumulates in developer GI. In this connection, when a durability test was conducted for an image forming apparatus according to this embodiment, noticeable agglomeration of developer G1 did not occur even after the number of sheets printed reached 6,000.

The developing roller 15 must be rotated in the reverse direction at least until agglomerate G2 stopping at the space between the developing roller 15 and regulating blade 16 reaches the supplying roller 17. That is, the developing roller 15 must be rotated in the reverse direction by angle of degrees larger 15 than an angle formed by a line connecting the center of the developing roller 15 and a contact point for the regulating blade 16 and the developing roller 15 and a line connecting the center of the developing roller 15 and a contact point for the supplying roller 17 and the developing roller 15.

Figure 3:
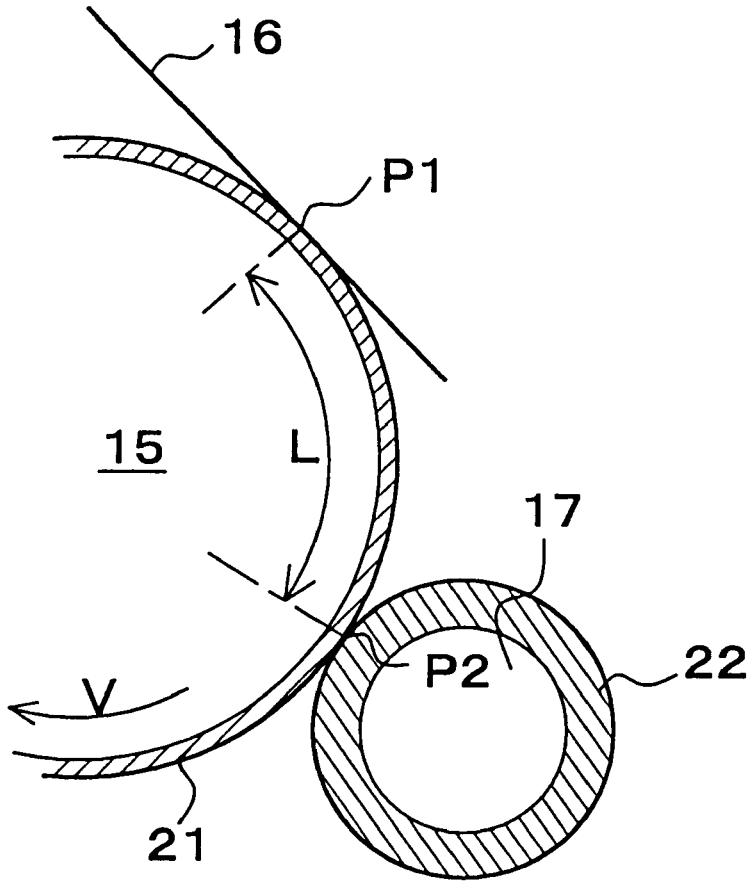
FIG. 3 shows relative positioning of a supply roller and a developing roller for the image forming apparatus according to FIG. 1, and an angle of reverse rotation for the developing roller.

As shown in FIG. 3, P1 and P2 represent contact points for the developing roller 15 and the regulating blade 16, the developing roller 15 and the supplying roller 17, respectively. L for a length of arc between P1 and P2 has been known according to specifications of the developing apparatus 10. Angular velocity V for reverse rotation velocity of the developing roller 15 is also known according to specifications of the developing apparatus 10. Accordingly, the developing roller 15 may keep rotating in the reverse direction for a period longer than L/V, the period obtained when length (L) is divided by angular velocity (V).

The developing roller 15 should be rotated in the reverse direction during periods other than the period when developer G1 is supplied from the developing roller 15 to the photosensitive drum 11. Otherwise, image formation does not go well. Accordingly, it is preferable that the developing roller 15 be rotated in the reverse direction during a non-image-formation period. For example, the developing roller 15 can be rotated in the reverse direction when an image forming apparatus starts up or finishes image formation. In case developer G1 is likely to gather together easily, the developing roller 15 should be rotated in the reverse direction, preferably, every time when the certain number of sheets of image formation is finished. In case developer G1 is not so likely to gather together, the developing roller 15 may be rotated in reverse direction only when an image forming apparatus starts up and when finishes image formation. Further, as to an image forming apparatus employing a plurality of developing apparatus, such as a full-color copying machine and printer, developing rollers for developing apparatus not attending image formation may be rotated in reverse direction while other developing apparatus attends image formation.

As described in the above, according to the present invention, a supply roller 17 being in contact with a developing roller 15 is disposed at a position upper stream than the regulating member while the developing roller 15 is rotated in its predetermined rotating direction (direction B). The developing roller 15 is rotated in the reverse direction periodically so that G2, the agglomerate of developer G1, stopping at the space between the developing roller 15 and the regulating blade 16 can escape therefrom and the supplying roller 17 can come to contact with and crack the agglomerates G2 escaped from the space. The above-described mechanism realizes a developing apparatus 10 wherein defective supply of developer G1 caused by agglomerate G2 stopping at the space between a regulating blade 16 and a developing roller 15 is prevented and an image forming apparatus using the developing apparatus 10. Such mechanism prevents agglomerate G2 once escaped from the space from stopping at the space again and lessen occurrence frequency that agglomerate G2 accumulates in developer G1 and stops at the space.

The present embodiment is an example and does not limit the present invention in any respect. Accordingly, the present invention can be variously improved and changed within the scope not departing the subject matter thereof. For example, although the present embodiment employs a supplying roller 17 to press with the developing roller 15 and crash agglomerate G2, other member may be employed. For example, a member for collecting agglomerate G2 may be employed. A contact member needs not to concurrently work as a supplying roller 17 as means for supplying/collecting developer G1 but other structural component may be applied.

What is claimed is:

1. A developing apparatus including:

a developer carrier for carrying developer on a surface thereof, the developer carrier rotating in a predetermined direction;

a regulating member for regulating a thickness of a developer layer on the developer carrier at a regulating position;

a contact roller being in contact with the surface of the developer carrier upstream of the regulating position while the developer carrier is rotated in its predetermined rotating direction, the contact roller rotating in a direction such that a surface of the contact roller is moving in an opposite direction as an adjacent surface of the developer carrier at a contact portion where the contact roller contacts the developer carrier; and a controller for controlling rotation of the developer carrier in a direction opposite to the predetermined direction during a predetermined period so that the surface of the contact roller and the adjacent surface of the developer carrier move in a same direction at the contact portion.

2. A developing apparatus according to claim 1, wherein the contact roller is a developer-supplying roller for supplying developer to the developer carrier.

3. A developing apparatus according to claim 1, wherein the contact roller is a developer-supplying/collecting member for supplying developer to the developer carrier and for collecting developer remaining on the developer carrier after development.

4. A developing apparatus according to claim 1, wherein the contact roller is an elastic roller.

5. A developing apparatus according to claim 4, wherein the contact roller has a foam layer on its surface.

6. A developing apparatus according to claim 1, wherein the controller controls the rotation of the developer carrier in the opposite direction for the predetermined period at least until a position of the developer carrier that faced the regulating member reaches the contact roller.

7. A developing apparatus according to claim 1, wherein one-component developer is used.

8. A developing apparatus according to claim 7, wherein non-magnetic one-component developer is used.

9. A developing apparatus according to claim 1, further including a power source unit for applying bias-voltage which is a superimposing of DC voltage and AC voltage to the developer carrier.

10. A developing apparatus including:

a developer carrier for carrying developer on a surface thereof while rotating in a predetermined direction, the developer carrier rotating in a reverse direction with respect to the predetermined direction during a predetermined period;

a regulating member for regulating a thickness of a developer layer on the developer carrier at a regulating position;

a contact roller being in contact with the surface of the developer carrier upstream of the regulating position while the developer carrier is rotated in its predetermined rotating direction;

wherein a surface of the contact roller and the surface of the developer carrier move in opposite directions at a contact portion while the developer carrier is rotated in the predetermined direction, and the surface of the contact roller and the surface of the developer carrier move in the same direction at the contact portion while the developer carrier is rotated in the reverse direction.

11. A developing apparatus according to claim 10, wherein the contact roller is a developer-supplying/collecting member for supplying developer to the developer carrier and for collecting developer remaining on the developer carrier after development.

12. A developing apparatus according to claim 10 wherein the contact roller is an elastic roller.

13. A developing apparatus according to claim 10, wherein non-magnetic one-component developer is used.

14. An image forming apparatus including:

an image carrier for carrying a latent image on a surface thereof;

a developing apparatus supplying developer to the image carrier to develop the latent image, the developing apparatus including:

a developer carrier disposed against the image carrier, the developer carrier carrying developer and rotating in a predetermined direction;

a regulating member for regulating a thickness of a developer layer on the developer carrier at a regulating position;

a contact roller being in contact with the surface of the developer carrier upstream of the regulating position while the developer carrier is rotated in its predetermined rotating direction such that a surface of the contact roller is moving in an opposite direction as an adjacent surface of the developer carrier at a contact portion where the contact roller contacts the developer carrier;

a controller for controlling rotation of the developer carrier in a direction opposite to the predetermined direction during a predetermined period so that the surface of the contact roller and the adjacent surface of the developer carrier move in a same direction; and a power source unit for applying a bias voltage.

15. An image forming apparatus according to claim 14, wherein the contact roller is a developer-supplying/collecting roller for supplying developer to the developer carrier and for collecting developer remaining on the developer carrier after development.

16. An image forming apparatus according to claim 14, wherein the contact roller is an elastic roller.

17. An image forming apparatus according to claim 14, wherein one-component developer is used.

18. An image forming apparatus according to claim 17, wherein non-magnetic one-component developer is used.

19. An image forming apparatus according to claim 14, wherein the developing apparatus lets developer on the developer carrier fly therefrom and gets the latent image developed.

20. An image forming apparatus according to claim 14, wherein the bias-voltage is a superimposing of DC voltage and AC voltage.

* * * * *